US007013770B2

(12) United States Patent
Williams

(10) Patent No.: US 7,013,770 B2
(45) Date of Patent: Mar. 21, 2006

(54) ENGINE TILTING TOOL

(75) Inventor: Danny Williams, Clarinda, IA (US)

(73) Assignee: Lisle Corporation, Clarinda, IA (US)

( * ) Notice: Subject to any disclaimer, the term of this patent is extended or adjusted under 35 U.S.C. 154(b) by 334 days.

(21) Appl. No.: 10/408,903

(22) Filed: Apr. 8, 2003

(65) Prior Publication Data

US 2004/0200326 A1 Oct. 14, 2004

(51) Int. Cl.
*B25B 11/00* (2006.01)

(52) U.S. Cl. ..... 81/484; 81/171; 269/6

(58) Field of Classification Search ..... 81/484, 81/171; 269/43, 6, 3, 95; 294/81.3, 67.5
See application file for complete search history.

(56) References Cited

U.S. PATENT DOCUMENTS 281,456 A * 7/1883 Cline ..... 81/171
833,865 A * 10/1906 Beason ..... 81/156
4,431,223 A * 2/1984 Miller ..... 294/81.4
4,936,616 A * 6/1990 Williams ..... 294/81.3

OTHER PUBLICATIONS

Invention Disclosure, Stephen R. Ref, Transverse Engine Tilter, Feb. 14, 1992.

* cited by examiner

*Primary Examiner*—Derris H. Banks
*Assistant Examiner*—J Williams
(74) *Attorney, Agent, or Firm*—Banner & Witcoff, Ltd.

(57) ABSTRACT

An engine tilting tool used to tilt transversely mounted General Motors engines includes a tubular bracket member which receives a telescoping tubular member that is driven telescopically by means of a drive rod mounted on the bracket member. The bracket member is attached to the vehicle engine compartment in place of one end of the "dog bone" strut engine support and the telescoping tubular member is attached to the engine in place of the opposite end of the strut engine support. A nut is used to adjust the position of the telescoping tube relative to the tubular bracket member to thereby effect tilting of the engine.

5 Claims, 1 Drawing Sheet

FIG.1
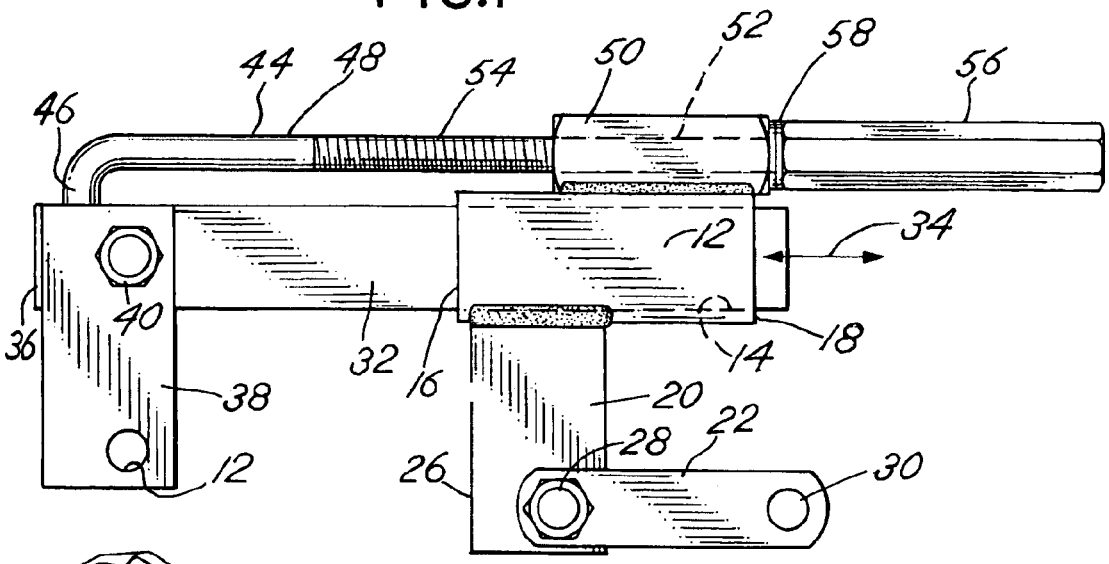
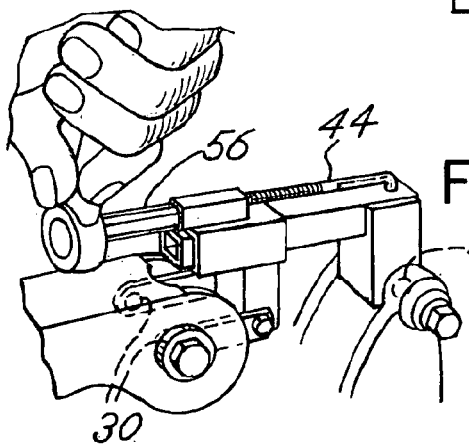
FIG.3
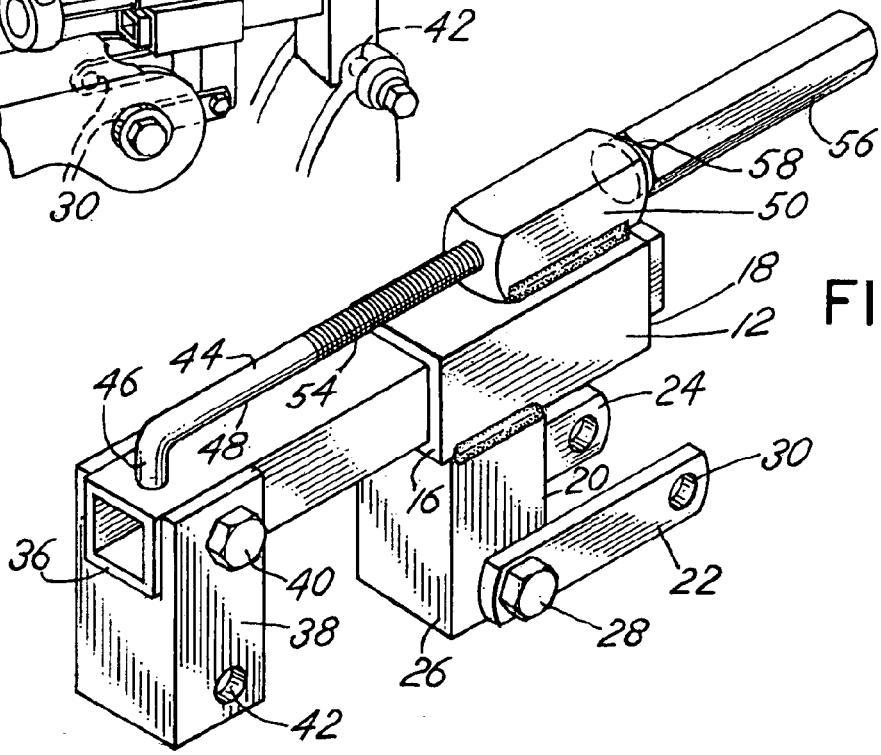
FIG.2

ENGINE TILTING TOOL

BACKGROUND OF THE INVENTION

In principal aspect of the present invention relates to a tool used to support and tilt the engine of a motor vehicle in the engine compartment of the vehicle so that the component parts of the engine, such as spark plugs and the like, will be more accessible for purposes of service or replacement.

Front wheel drive vehicles typically include an engine which is mounted transverse to the longitudinal axis of the vehicle. Such engines, particularly in General Motors vehicles, may be difficult to service inasmuch as the component parts, such as spark plugs, the oxygen sensor, ignition coil and the like, are positioned in a manner which makes access thereto somewhat difficult. In order to improve accessibility, the engine struts, which are often referred to as "dog bone" struts, may be detached and replaced by a mechanism which is operated to tilt the engine a limited amount while in the engine compartment. Such tilting exposes and makes more readily accessible the parts of the engine or components attached to the engine, which require servicing.

Various prior art engine tilting devices are available in the marketplace. For example, Thexton distributes a General Motors engine moving tool, Product Number 419X. The tool is placed in the position of the "dog bone" struts and adjusted to tilt the engine. Lisle Corporation has in the past sold an engine tilting device for transversely mounted General Motors engines, Model No. 22550 Engine Tilter, which also is designed to replace the "dog bone" struts.

While such tools are useful, there remains a need for an inexpensive yet rugged and efficient engine tilting tool.

SUMMARY OF THE INVENTION

Briefly the present invention comprises an engine tilting tool having a distinct design relative to prior art engine tilting tools generally used with General Motors transversely mounted, front wheel drive vehicle engines. The tool is positioned in the place of "dog bone" struts and is comprised of a tubular bracket member, having a depending attachment leg that may be pivotally attached at one end of a "dog bone" strut attachment point in the engine compartment. A telescoping tube is slidably mounted in the tubular bracket member. The telescoping tube includes a drive rod attached to an outer end thereof. The drive rod cooperates with a tube translation mechanism mounted on the tubular bracket so that the longitudinal position of the telescoping tube within the tubular bracket may be adjusted. The outer end of the telescoping tube further includes an extension member, which may be pivotally attached to the attachment connection point of the "dog bone" strut to the vehicle engine.

Thus, in order to tilt an engine about mounting pins or bolts in the engine compartment, the telescoping tube extension member is attached to the engine at the connection point of the "dog bone" strut and the tubular bracket depending attachment leg of the tool is attached to the engine compartment at the "dog bone" strut connection point. Then by slidably adjusting the position of the telescoping tube within the tubular bracket member, the engine may be efficiently and effectively tilted and maintained in an adjusted, tilted position.

In the preferred embodiment, slidable adjustment of the telescoping tube is effected by means of turning a nut which engages a threaded end of the drive rod which passes through a through passage of a guide member mounted on the tubular bracket member.

Thus it is an object of the invention to provide an inexpensive, yet exceedingly rugged and strong tool to replace the "dog bone" struts of a General Motors type transversely mounted engine to effect tilting of the engine.

It is a further object of the invention to provide an engine tilting tool which includes an adjustable telescoping link or member useful for effecting the tilting of a vehicle engine by attachment between connection points on the engine and connection points in the engine compartment.

Yet another object of the invention is to provide an engine tilting tool and a method of tilting an engine which utilizes a means to adjust the distance of the linkage between the "dog bone" strut connection points for such a vehicle engine in an engine compartment.

These and other objects, advantages and features of the invention will be set forth in the detailed description which follows.

BRIEF DESCRIPTION OF THE DRAWING

In the detailed description as follows reference will be made to the drawing comprised of the following figures:

FIG. 1 is a side elevation of the engine tilting tool of the invention;

FIG. 2 is an isometric view of the tool of FIG. 1; and

FIG. 3 is an isometric view of the tool of FIG. 1 as incorporated and positioned in an engine compartment, for tilting of the engine and illustrating the method of use of the engine tilting tool.

DESCRIPTION OF THE PREFERRED EMBODIMENT

As shown in the figures, the tool of the invention includes a tubular bracket member 12 which is comprised of a generally square cross section tubular member having a throughpassage 14 extending from a forward end 16 through a rear or back side or back end 18. A depending attachment leg 20 extends vertically downwardly from the tubular bracket member 12 and is welded thereto. The depending attachment leg 20 further includes a first linkage bar or a link 22 and a second, generally parallel, substantially identical linkage bar or link 24. Linkage bars 22 and 24 are pivotally attached to the lower end 26 of the attached leg 20 by means of a pivot pin or bolt 28. The links 22 and 24 each include a throughpassage 30 at their outer free end, which enables attachment of the links 22 and 24 to an attachment bracket connection point in the engine compartment for a "dog bone" strut.

A telescoping tube 32 is slidably and telescopically positioned within the tubular bracket 12 for sliding movement longitudinally in the direction of the axis 34 as depicted in the figures. The outer configuration of tubular bracket 12 is generally congruent in cross section with through-passage 14. Thus, the sliding, telescoping tube or member 32 is keyed or non-rotational relative to the bracket member 12 in the preferred embodiment. In the embodiment depicted such keyed relationship is accomplished by utilizing a polygonal (square) cross section shape for the telescoping tube 32 fitted through a congruent polygonal (square) passage or throughbore 14 in bracket member 12. Other keying relationship or means may be utilized to preclude relative rotation about the longitudinal axis 34.

Attached at a first or outer end 36 of the telescoping tube 32 is an engine attachment tube or member 38. The engine attachment member 38 is attached to the outer end 36 of the telescoping tube 32 by means of attachment pin or bolt 40. Thus, the engine attachment member 38 extends downwardly from tube 32. The engine attachment member 38 further includes a through passage or opening 42 which enables attachment thereof to the link or attachment member or connection point for the "dog bone" strut that is typically incorporated in or on the vehicle engine.

The device further includes an L shaped drive rod 44. The drive rod 44 includes a depending leg 46 which is fixed to the outer end 36 of the tubular telescoping tube 32. Rod 44 further includes a longitudinal leg 48 parallel to the longitudinal axis 34. Leg 48 extends through a hollow guide member 50 welded to the top of the tubular bracket member 12. The leg 48 is slidably moveable through the guide member 50 and, more particularly, through a cylindrical passageway 52 through the guide member 50. The leg 48 is threaded at its outer end 54 and receives a nut 56. Washers 58 are mounted on the rod 48 between the nut 56 and the guide member 50 and serve as a bushing. The rod 44 may thus be moved longitudinally in the direction of the axis 34 by turning the nut 56.

In operation, the attachment leg 20, and more particularly the links 22 and 24, are attached to one end of the normal attachment point of a "dog bone" strut in an engine compartment. The opposite end of the tool and, more particularly, the attachment member 38 is attached to the opposite vehicle engine end of the typical attachment point of a "dog bone" strut. The nut 56 may then be rotated so as to adjust the telescoping position of tube 32 in bracket 12 and thus the tilt of the engine due to the change of the distance between the pivot points 42 and 30. In this manner by replacement of the dog bone struts with the tool of the invention, one can easily effect tilting of the engine. Because the device is constructed with a parallel drive rod 44 and telescoping tube 32, the construction is compact, yet highly rugged. Variations of the device are possible including changes in dimensions of the component parts and the shape or cross sectional construction of the component parts. For example, the tubular bracket member 12 and sliding tube 32 may be cylindrical or polygonal or otherwise keyed to each other for sliding longitudinal movement. However, the component parts as described, provide an exceedingly rugged and cost-effective tool.

In practice, one or two of the tools may be used. Typically two of the tools are used in an engine compartment to replace the two "dog bone" struts for a General Motors transversely mounted engine. Thus, the invention is to be limited only by the following claims and equivalents thereof.

What is claimed is:

1. An engine tilting tool for mounting in a vehicle engine compartment for attachment to and tilting of a vehicle engine, said tool comprising, in combination:

a first tubular bracket member having a depending attachment leg and a tubular throughpassage;

a telescoping tube having a first outer end, said telescoping tube slidably mounted in the tubular bracket member throughpassage;

an engine attachment member attached at a first outer end of the telescoping tube;

a drive rod attached to the first outer end of the telescoping tube, said drive rod extending generally parallel to the telescoping tube from the first end toward the tubular bracket member and extending over the tubular bracket member;

a drive rod translation assembly mounted on the tubular bracket member for engaging and translating the drive rod and attached telescoping tube longitudinally with respect to the tubular bracket member;

and an attachment mechanism for the attachment leg whereby the tubular bracket member attachment leg may be attached to an engine compartment housing and the engine attachment member may be attached to an engine in the engine compartment to pivotally move the engine.

2. The tool of claim 1 wherein the translation assembly includes a guide member mounted on the tubular bracket member and a threaded nut to translate the rod and attached telescoping tube.

3. The tool of claim 1 wherein the attachment mechanism includes a linkage bar for attachment to an engine compartment.

4. An engine tilting tool comprising, in combination:

a bracket member with a first end and a first attachment mechanism at the first end for attachment to an engine compartment housing;

a slidable link telescopically mounted in the bracket member, said link having an outer end including a second attachment mechanism for attachment to an engine in the engine compartment; and a link control mechanism for controlling the telescopic extension of the link from the bracket member, whereby attachment of the first attachment mechanism of the bracket member to the engine compartment and the second attachment mechanism to the engine enables tilting of the engine by adjustment of the link control mechanism.

5. A method for tilting an engine mounted in a vehicle engine compartment for servicing of the engine said engine supported by a strut connecting a connection point in the compartment and a connection point on the engine, said method comprising, in combination, the steps of:

positioning a tool having a first tubular bracket member having a depending attachment leg and first attachment mechanism attached to the compartment connection point, said bracket member including a tubular throughpassage with a telescoping tube slidably mounted in the tubular bracket member throughpassage, an engine attachment member attached at a first end of the telescoping tube, said engine attachment member attached to the engine connection point, said tool also having a drive rod attached to the first end of the telescoping tube, said drive rod extending generally parallel to the tube from the first end toward the tubular bracket and said tool having a drive rod translation assembly mounted on the tubular bracket for engaging and translating the rod and attached telescoping tube longitudinally with respect to the tubular bracket; and adjusting the drive rod translation assembly to translate the drive rod and thereby pivotally move the engine with the attachment member attached to the engine and the attachment leg first attachment mechanism attached to the engine compartment.

* * * * *